US008777010B2

(12) United States Patent
Wnek

(10) Patent No.: US 8,777,010 B2
(45) Date of Patent: Jul. 15, 2014

(54) CONTAINER BLANK AND CONTAINER WITH DENESTING FEATURE

(75) Inventor: Patrick H. Wnek, Sherwood, WI (US)

(73) Assignee: Graphic Packaging International, Inc., Atlanta, GA (US)

( * ) Notice: Subject to any disclaimer, the term of this patent is extended or adjusted under 35 U.S.C. 154(b) by 861 days.

(21) Appl. No.: 12/868,850

(22) Filed: Aug. 26, 2010

(65) Prior Publication Data

US 2011/0048999 A1 Mar. 3, 2011

Related U.S. Application Data

(60) Provisional application No. 61/275,215, filed on Aug. 26, 2009.

(51) Int. Cl.

| | |
|---|---|
| ***B65D 21/00*** | (2006.01) |
| ***B65D 85/62*** | (2006.01) |
| ***A47G 19/00*** | (2006.01) |
| ***A47G 21/00*** | (2006.01) |
| ***A47G 23/00*** | (2006.01) |
| ***B65D 6/00*** | (2006.01) |
| ***B65D 8/04*** | (2006.01) |
| ***B65D 8/18*** | (2006.01) |
| ***B65D 90/02*** | (2006.01) |
| ***B65D 1/00*** | (2006.01) |

(52) U.S. Cl.

USPC ..... 206/503; 206/499; 206/500; 206/519; 220/574; 220/670; 220/673; 229/407

(58) Field of Classification Search

USPC ..... 206/499, 500, 503, 519; 220/670, 673

See application file for complete search history.

(56) References Cited

U.S. PATENT DOCUMENTS

| | | | | |
|---|---|---|---|---|
| 1,022,882 | A | | 4/1912 | Schwenn |
| 2,522,397 | A | | 9/1950 | Palmer |
| 2,634,880 | A | | 4/1953 | Gravatt |
| 3,033,434 | A | | 5/1962 | Carson |
| 3,099,377 | A | | 7/1963 | Metzler et al. |
| 3,195,770 | A | | 7/1965 | Robertson |
| 3,220,631 | A | | 11/1965 | Reifers |
| 3,229,886 | A | | 1/1966 | Grogel |
| 3,286,876 | A | | 11/1966 | Ring |
| 3,315,018 | A | * | 4/1967 | Commeyras ..... 264/51 |
| 3,530,917 | A | | 9/1970 | Donavan |

(Continued)

FOREIGN PATENT DOCUMENTS

| | | |
|---|---|---|
| DE | 509 065 | 4/1969 |
| DE | 80 11 020 | 9/1980 |

(Continued)

OTHER PUBLICATIONS

EP 03 77 6279—Supplementary European Search Report.

(Continued)

*Primary Examiner* — Fenn Mathew
*Assistant Examiner* — Andrew T Kirsch
(74) *Attorney, Agent, or Firm* — Womble Carlyle Sandridge & Rice, LLP

(57) ABSTRACT

A blank for being formed into a container. The blank has a marginal area that includes a plurality of score lines for facilitating forming of the blank into the container. The score lines are positioned to facilitate formation of denesting features of the container. A container formed from the blank has denesting features.

11 Claims, 6 Drawing Sheets

(56) References Cited

U.S. PATENT DOCUMENTS

| | | | | |
|---|---|---|---|---|
| 3,669,305 | A | 6/1972 | Kinney et al. | |
| 3,680,733 | A | 8/1972 | Winslow | |
| 3,684,633 | A | 8/1972 | Haase | |
| 3,720,365 | A * | 3/1973 | Unger | 229/406 |
| 3,850,340 | A | 11/1974 | Siemonsen et al. | |
| 3,968,921 | A | 7/1976 | Jewell | |
| 4,051,707 | A | 10/1977 | Valek et al. | |
| 4,096,947 | A | 6/1978 | Morse | |
| 4,139,115 | A | 2/1979 | Robinson | |
| 4,183,435 | A | 1/1980 | Thompson et al. | |
| 4,202,464 | A | 5/1980 | Mohs et al. | |
| 4,606,496 | A | 8/1986 | Marx et al. | |
| 4,609,140 | A | 9/1986 | Van Handel et al. | |
| 4,704,510 | A | 11/1987 | Matsui | |
| 4,721,499 | A | 1/1988 | Marx et al. | |
| 4,721,500 | A | 1/1988 | Van Handel et al. | |
| 4,775,771 | A | 10/1988 | Pawlowski et al. | |
| 4,832,676 | A | 5/1989 | Johns et al. | |
| 4,865,921 | A | 9/1989 | Hollenberg et al. | |
| 4,890,439 | A | 1/1990 | Smart | |
| 4,935,089 | A | 6/1990 | Schirmer | |
| 4,936,935 | A | 6/1990 | Beckett | |
| 4,963,424 | A | 10/1990 | Beckett | |
| 4,967,908 | A | 11/1990 | Kessler | |
| 5,039,364 | A | 8/1991 | Beckett et al. | |
| 5,117,078 | A | 5/1992 | Beckett | |
| 5,190,209 | A | 3/1993 | Gordon et al. | |
| 5,213,902 | A | 5/1993 | Beckett | |
| 5,221,419 | A | 6/1993 | Beckett | |
| 5,260,537 | A | 11/1993 | Beckett | |
| 5,266,386 | A | 11/1993 | Beckett | |
| 5,269,717 | A | 12/1993 | Tardif | |
| RE34,683 | E | 8/1994 | Maynard et al. | |
| 5,340,436 | A | 8/1994 | Beckett | |
| 5,354,973 | A | 10/1994 | Beckett | |
| 5,410,135 | A | 4/1995 | Pollart et al. | |
| 5,424,517 | A | 6/1995 | Habeger, Jr. et al. | |
| 5,519,195 | A | 5/1996 | Keefer et al. | |
| 5,617,972 | A | 4/1997 | Morano et al. | |
| 5,628,921 | A | 5/1997 | Beckett | |
| 5,672,407 | A | 9/1997 | Beckett | |
| 5,758,773 | A | 6/1998 | Clements | |
| 5,759,422 | A | 6/1998 | Schmelzer et al. | |
| 5,782,376 | A | 7/1998 | Brauner et al. | |
| 5,800,724 | A | 9/1998 | Habeger et al. | |
| 5,934,472 | A | 8/1999 | Ramirez et al. | |
| 5,938,112 | A | 8/1999 | Sandstrom | |
| 6,093,460 | A | 7/2000 | Iwaya | |
| 6,114,679 | A | 9/2000 | Lai et al. | |
| 6,150,646 | A | 11/2000 | Lai et al. | |
| 6,204,492 | B1 | 3/2001 | Zeng et al. | |
| 6,213,301 | B1 | 4/2001 | Landis et al. | |
| 6,237,845 | B1 | 5/2001 | Hashimoto et al. | |
| 6,251,451 | B1 | 6/2001 | Zeng | |
| 6,325,213 | B1 | 12/2001 | Landis, II | |
| 6,414,290 | B1 | 7/2002 | Cole et al. | |
| 6,415,945 | B1 | 7/2002 | Zank et al. | |
| 6,433,322 | B2 | 8/2002 | Zeng et al. | |
| 6,455,827 | B2 | 9/2002 | Zeng | |
| 6,552,315 | B2 | 4/2003 | Zeng et al. | |
| 6,568,534 | B2 | 5/2003 | Zank | |
| 6,677,563 | B2 | 1/2004 | Lai | |
| 6,717,121 | B2 | 4/2004 | Zeng et al. | |
| 6,765,182 | B2 | 7/2004 | Cole et al. | |
| 6,988,654 | B2 | 1/2006 | Wnek | |
| 2002/0092791 | A1 | 7/2002 | Wnek | |
| 2002/0113118 | A1 * | 8/2002 | Littlejohn et al. | 229/407 |
| 2003/0205319 | A1 | 11/2003 | Bengtsson et al. | |
| 2004/0262322 | A1 | 12/2004 | Middleton et al. | |
| 2005/0109653 | A1 | 5/2005 | Wnek et al. | |
| 2006/0198972 | A1 | 9/2006 | Ueda et al. | |
| 2007/0081743 | A1 | 4/2007 | Kim | |
| 2007/0235514 | A1 | 10/2007 | Abayhan et al. | |
| 2007/0253314 | A1 | 11/2007 | Jones et al. | |
| 2007/0267374 | A1 | 11/2007 | Middleton et al. | |
| 2009/0223952 | A1 | 9/2009 | Wnek et al. | |

FOREIGN PATENT DOCUMENTS

| | | | |
|---|---|---|---|
| DE | 87 13 290.7 | | 1/1988 |
| DE | 37 37 052 | A1 | 5/1989 |
| DE | 296 02 348 | U1 | 5/1996 |
| DE | 101 49 143 | A1 | 4/2003 |
| EP | 0 082 209 | | 6/1983 |
| EP | 1 332 972 | | 8/2003 |
| FR | 2 266 638 | | 10/1975 |
| FR | 2 599 002 | | 11/1987 |
| FR | 2 733 715 | | 11/1996 |
| GB | 1 264 484 | | 2/1972 |
| GB | 1 348 370 | | 3/1974 |
| GB | 1 376 603 | | 12/1974 |
| GB | 2 075 462 | A | 11/1981 |
| GB | 2 171 048 | | 8/1986 |
| JP | 47-23456 | | 10/1972 |
| JP | 54-116059 | | 9/1979 |
| JP | 54-126887 | | 10/1979 |
| JP | 56065866 | U | 6/1981 |
| JP | 57-8651 | | 1/1982 |
| JP | 59-75004 | | 4/1984 |
| JP | 03-004582 | | 1/1991 |
| JP | 3057020 | U | 5/1991 |
| JP | 5-42928 | | 2/1993 |
| JP | 6000843 | | 1/1994 |
| JP | 60-96234 | | 4/1994 |
| JP | 07-28883 | | 1/1995 |
| JP | 08-156944 | | 6/1996 |
| JP | 3031361 | | 9/1996 |
| JP | 8-337234 | | 12/1996 |
| JP | 08-337235 | | 12/1996 |
| JP | 09-254948 | | 9/1997 |
| JP | 2000-043840 | | 2/2000 |
| JP | 2000-142825 | | 5/2000 |
| JP | 2000-238760 | | 9/2000 |
| JP | 2000-309326 | | 11/2000 |
| JP | 2000-335550 | | 12/2000 |
| JP | 2000-517260 | | 12/2000 |
| JP | 2001-213420 | | 8/2001 |
| JP | 2001-328617 | | 11/2001 |
| JP | 2007-510598 | | 4/2007 |
| KR | 20-0318533 | Y1 | 6/2003 |
| WO | WO 96-11142 | | 4/1996 |
| WO | WO 98-09812 | | 3/1998 |
| WO | WO 03/066435 | | 8/2003 |
| WO | WO 03/078012 | | 9/2003 |
| WO | WO 2004-033324 | | 4/2004 |
| WO | WO 2005/047126 | A2 | 5/2005 |
| WO | WO 2008-049048 | | 4/2008 |
| WO | WO 2009/058807 | A1 | 5/2009 |
| WO | WO 2009-086501 | | 7/2009 |
| WO | WO 2009-088904 | | 7/2009 |

OTHER PUBLICATIONS

PCT/US2007/081743 International Search Report & Written Opinion.

Notice of Reason for Rejection for JP 2012-52693 dated Oct. 10, 2013, with English translation.

* cited by examiner

CONTAINER BLANK AND CONTAINER WITH DENESTING FEATURE

CROSS-REFERENCE TO RELATED APPLICATIONS

This application claims the benefit of U.S. Provisional Patent Application No. 61/275,215, filed Aug. 26, 2009.

INCORPORATION BY REFERENCE

U.S. Provisional Patent Application No. 61/275,215, which was filed on Aug. 26, 2009, is hereby incorporated by reference for all purposes as if presented herein in its entirety.

BACKGROUND OF THE DISCLOSURE

The present disclosure relates to containers, trays, constructs, and/or blanks having features to facilitate denesting of stacked containers.

SUMMARY OF THE DISCLOSURE

In one aspect, the disclosure is generally directed to a blank for being formed into a container. The blank has a marginal area that includes a plurality of score lines for facilitating forming of the blank into the container. The score lines are positioned to facilitate formation of denesting features of the container.

In another aspect, the disclosure is generally directed to a container formed from a blank. The container includes denesting features that are formed by a plurality of score lines in a marginal portion of the blank.

In another aspect, the disclosure is generally directed to a blank for forming a container. The blank comprises a central portion, an edge, and a marginal portion between the edge and the central portion. The blank comprises a radius extending from a center of the blank to the edge. The marginal portion comprising a plurality of score lines. Each score line being positioned at an angle relative to the radius of the blank.

In another aspect, the disclosure is generally directed to a container formed from the blank having the features noted in the preceding paragraph. The container comprises a bottom wall formed from the central portion, a side wall extending upwardly from the bottom wall and being formed from at least a portion of the marginal portion, and a flange extending laterally outward from the side wall and being formed from at least a portion of the marginal portion.

In another aspect, the disclosure is generally directed to a container having an interior surface forming an interior space of the container and an exterior surface. The container comprises a bottom wall, a side wall extending upwardly from the bottom wall, and a flange extending laterally outward from a top of the side wall. The container has overlapped portions in at least a portion of the side wall and the flange. The overlapped portions form a first plurality of protrusions on the interior surface and a second plurality of protrusions on the exterior surface.

Those skilled in the art will appreciate the above stated advantages and other advantages and benefits of various additional embodiments reading the following detailed description of the embodiments with reference to the below-listed drawing figures.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The present disclosure relates generally to various aspects of containers, constructs, trays, materials, packages, elements, and articles, and methods of making such containers, constructs, trays, materials, packages, elements, and articles. Although several different aspects, implementations, and embodiments are disclosed, numerous interrelationships between, combinations thereof, and modifications of the various aspects, implementations, and embodiments are contemplated hereby. In one illustrated embodiment, the present disclosure relates to forming a container or tray for holding food items or various other articles. However, in other embodiments, the container or tray can be used to form other non-food articles or may be used for heating or cooking.

Figure 1:
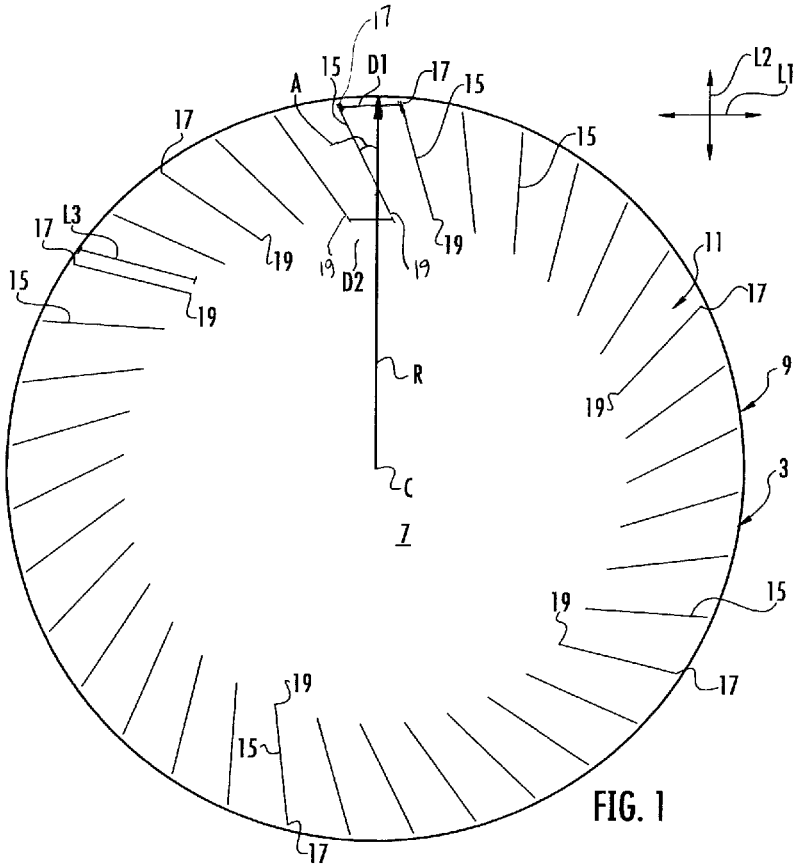
FIGS. 1-4 show various views of various features of a blank and/or container of one embodiment of the present disclosure.

FIG. 1 is a plan view of a blank 3 used to form a container 5 (FIG. 2) of one embodiment of the disclosure. In the illustrated embodiment, the blank 3 is generally circular and is for being press formed into the container 5 that is a generally circular tray. It is understood that the blank 3 can be press-formed into the container 5 by conventional forming tools such as are disclosed in U.S. Patent Application Publication No. 2005/0109653, the entire contents of which are incorporated herein by reference for all purposes. Also, the blank 3 can be press-formed into the container by other forming tools, such as are disclosed in International Publication No. WO 2008/049048, the entire contents of which are incorporated by reference for all purposes, or any other suitable forming tool assembly. Also, the blank 3 and the container 5 could be shapes other than circular (e.g., oval, rectangular, irregular, etc) without departing from the scope of this disclosure. The blank 3 of the present disclosure has features that allow the blank to be made of thinner material (e.g., paperboard) than is conventionally used, while still comprising denesting features that allow stacked containers to be easily separated.

As shown in FIG. 1, the blank 3 has a central portion 7, a radial edge 9, and a marginal portion 11 between the radial edge and the central portion. The blank 3 includes a lateral axis L1 and a longitudinal axis L2 that is generally perpendicular to the lateral axis. In the illustrated embodiment, the blank 3 includes a radius R that extends from the center C of the blank to the radial edge 9.

In one embodiment, the marginal portion 11 of the blank 3 includes a plurality of score lines 15. The score lines 15 are positioned at an angle A relative to the radius R. As shown in FIG. 1, each of the respective plurality of score lines 15 are oblique relative to each other, but the score lines could be otherwise positioned. In one embodiment the score lines 15 each extend from a first end point 17 that is spaced radially inward from the radial edge 9 to a second end point 19 that is adjacent the central portion 7 of the blank 3. In the illustrated embodiments the first end points 17 of adjacent score line 15 are spaced apart a distance D1, and the second end points 19 of adjacent score lines are spaced apart a distance D2. The scores lines 15 each have a length L3 between the first end point 17 and the second end point.

In one embodiment, the blank 3 has a radius R of at least approximately 3 inches (76 mm), and in the illustrated embodiment, at least approximately 3⅜ inches (86 mm). In one embodiment, the score lines 15 have a length L3 of at least about ¾ inch (19 mm), and in the illustrated embodiment, at least about 1 inch (25 mm). In one embodiment, the distance D1 between the first end points 17 is at least approximately ¼ inch (6 mm), and in the illustrated embodiment at least about ½ inch (13 mm). In one embodiment, the distance D2 between the second end points 19 is at least approximately ⅛ inch (3 mm), and in the illustrated embodiment, is at least approximately ⅜ inch (9.5 mm). In one embodiment, the angle A is at least about 15 degrees, in the illustrated embodiment, the angle A is at least about 30 degrees, and in another embodiment, the angle A is at least about 60 degrees. In one embodiment, the blank 3 comprises 18 point paperboard having a thickness of approximately 0.018" (0.46 mm), but the blank 3 could have a larger or smaller thickness or could comprise other materials. In one embodiment, the distance D1 is at least about 25% greater than the distance D2, and in the illustrated embodiment, is at least about 33% greater. In one embodiment, the length L3 is at least about 10% of the radius R, in another embodiment, the length L3 is at least about 25% of the radius R, and in the illustrated embodiment, the length L3 is at least about 30% of the radius R. All of the dimensional information presented herein is intended to be illustrative of certain aspects of the disclosure and is not intended to limit the scope of the disclosure, as various other embodiments of the disclosure could include dimensions that are greater than or less than the dimensions included herein.

Figure 2:
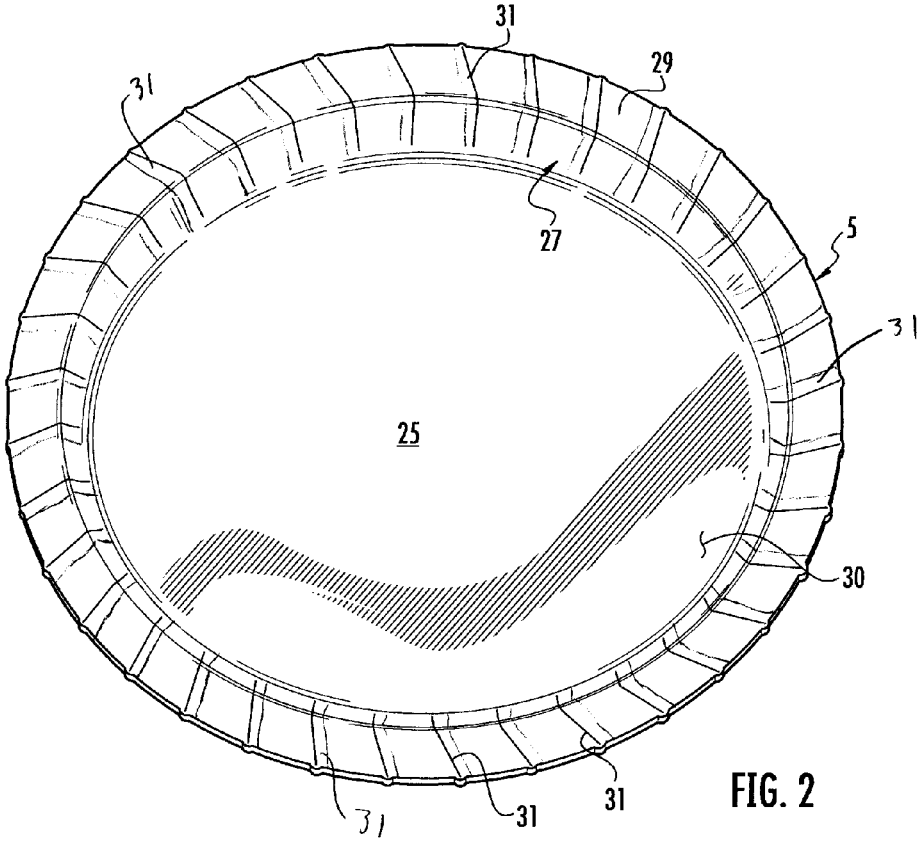
Figures 3, 3A:
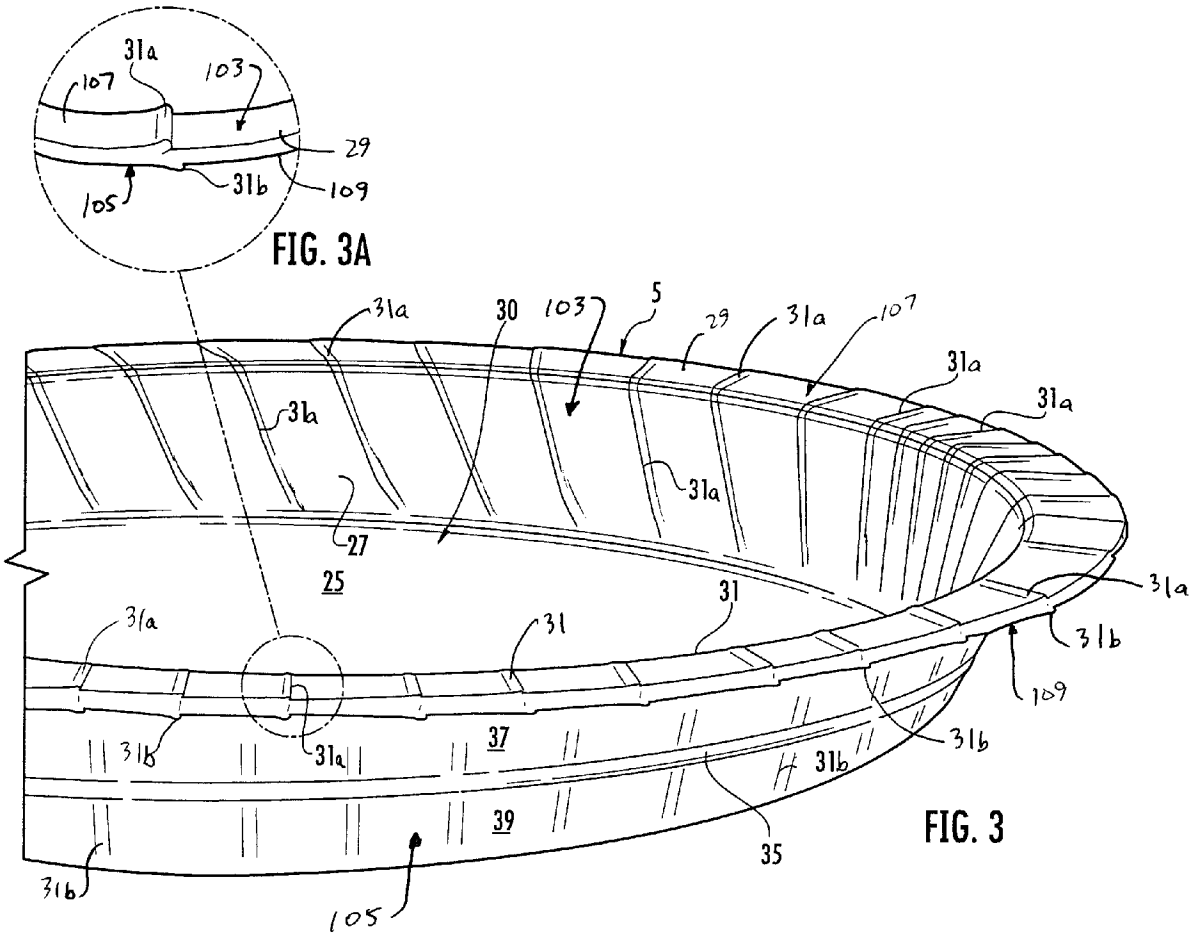
Figure 4:
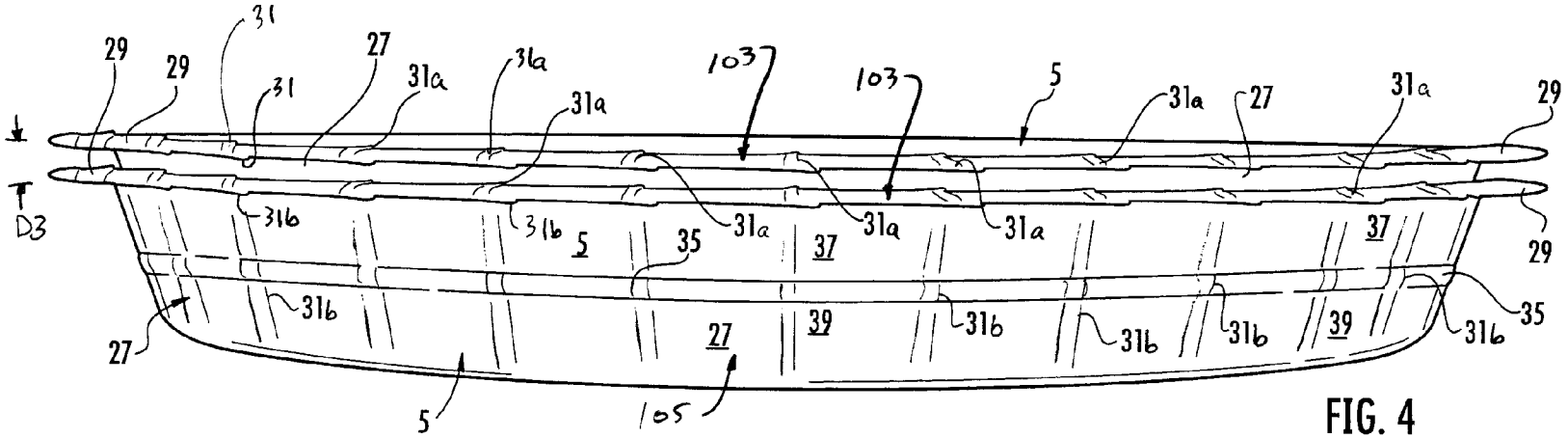

As shown in FIGS. 2 and 3, the container 5 formed from the blank 3 includes a bottom wall 25, a side wall 27 extending upwardly from bottom wall, and a flange 29 extending outwardly from the top of the side wall. The container 5 has an interior surface 103 and an exterior surface 105. The bottom wall 25 and side wall 27 at least partially define an interior space 30 of the interior surface 103 of the container 5. As shown in FIGS. 3, 3A, and 4, when the blank 3 is formed into the container 5, the score lines 15 form overlapped portions or pleats 31. Some of the overlapped portions 31 are protrusions that protrude outwardly from the interior surface 103 and others of the overlapped portions 31 are protrusions that protrude outwardly from the exterior surface 105 of the container 5. As shown in FIGS. 3 and 4, the overlapped portions or protrusions 31*a* on the interior surface 103 extend upwardly from a top surface 107 of the flange 29 and the overlapped portions or protrusions 31*b* on the exterior surface 105 extend downwardly from a bottom surface 109 of the flange. In the illustrated embodiment, the overlapped portions 31 are in the flange 29 of the container and the side wall 27, and extend down the side wall to a location adjacent the bottom wall 25. The overlapped portions 31 or protrusions could be otherwise shaped, arranged, and/or configured without departing from the disclosure.

As best shown in FIGS. 3 and 4, the forming tool (not shown) that presses the blank 3 into the container forms a stacking lug 35 on the exterior surface 105 of the side wall 27. In the illustrated embodiment, the stacking lug 35 extends outwardly from the exterior surface 105 of the container 5 around the perimeter of the side wall 27. The stacking lugs 35 are adjacent two compressed portions 37, 39 of the exterior surface 105 of the container. At the compressed portions 37, 39, the overlapped portions 31 are compressed at two locations adjacent to the stacking lug 35 so that the exterior surface 105 is substantially smooth at the compressed portions. The stacking lug 35 is formed by the uncompressed portions of the overlapped portions 31 on the exterior surface 105 of the container that protrude laterally outward from the compressed portions 37, 39. The stacking lugs 35 and compressed portions 37, 39 of the exterior surface 105 form denesting features for separating stacked containers. The stacking lug 35 and the compressed portions 37, 39 could be otherwise shaped and located without departing from the disclosure.

Figure 5:
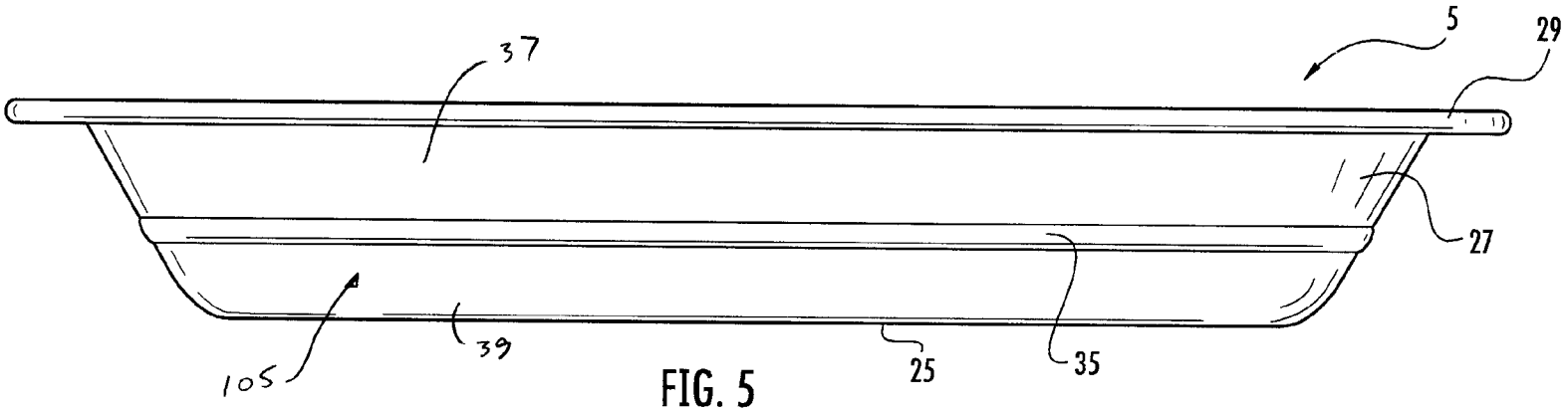
FIGS. 5 and 6 show various views of various features of a container of a second embodiment of the present disclosure.

As shown in FIGS. 4 and 5, the containers 5 can be stacked in a generally nested configuration with the sidewall 27 of a top container at least partially received in the interior space 30 of a lower container. The containers 5 include denesting features to facilitate denesting, or separation of a container from the stack or nested configuration, by a denesting apparatus, such as the type disclosed in the incorporated by reference U.S. Patent Application Publication No. 2005/0109653, or any other type of denesting apparatus. The denesting features of the containers 5 include the stacking lugs 35 that allow the flanges 29 of the containers to be spaced apart from each other when the containers are in a stacked configuration. The stacking lug 35, protruding from the exterior surface 105 of the side wall 27 of a respective upper container 5, contacts the interior surface 103 of the side wall of the lower container that is located below the respective upper container in the nested configuration. The contact of the stacking lug 35 of the upper container 5 with the interior surface 103 of the side wall 27 of the lower container prevents the upper container 5 from being fully inserted into the interior space of the lower container so that the bottom walls 25 of respective containers are spaced apart from each other in the axial direction of the nested containers. Also, the flanges 29 of the containers 5 are spaced apart from each other in the axial direction of the nested containers by a distance D3 (FIG. 4) to facilitate denesting of the containers by use of a denesting apparatus that has features that slide between the adjacent flanges to separate or denest a respective container from the stacked arrangement.

The containers 5 can include other denesting features, such as any of the denesting features disclosed in the incorporated by reference U.S. Patent Application Publication No. 2005/0109653, or any other feature.

The orientation of the score lines 15 of the blank 3 of the present disclosure allow the overlapped portions or pleats 31 to protrude outward from the exterior surface 105 of the container 5 a sufficient distance to create the stacking lugs 35 when the 3 blank comprises a material having a reduced thickness (18 pt or less). The angular placement of the score lines 15 allows more material to accumulate at the pleats 31 so that height of the stacking lugs 35 is maintained even with the use of paperboard having a reduced thickness. The thicker stacking lugs 35 will keep multiple containers 5 (FIG. 4) spaced apart an increased stacking distance D3 to improve denestability of the trays. Such an increase in the stacking distance D3 can be seen in containers 5 formed from blanks 3 having angled score lines 15 and reduced thickness and lower cost material.

Figure 6:
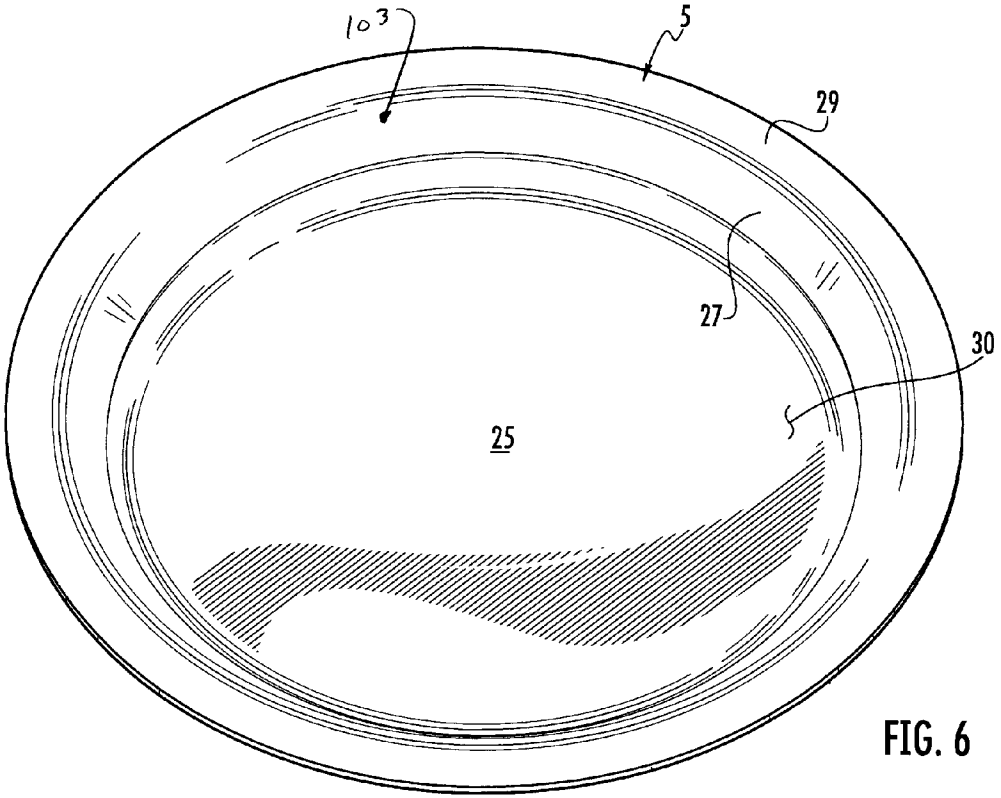

FIGS. 5 and 6 show the container 5 that has been coated with an external layer to form substantially smooth interior and exterior surfaces 103, 105 of the container. As with the previous embodiment, the container of FIGS. 5 and 6 has a stacking lug 35 protruding from the compressed portions 37, 39 of the exterior surface 105 to provide the denesting features of the container.

In accordance with the above-described embodiments of the present disclosure, a score line can be any substantially linear, although not necessarily straight, form of weakening that facilitates folding therealong. More specifically, but not for the purpose of narrowing the scope of the present disclosure, score lines include: a fold line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

The foregoing description illustrates and describes various embodiments of the present disclosure. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, and alterations, etc., of the above-described embodiments. Additionally, the disclosure shows and describes only selected embodiments, but various other combinations, modifications, and environments are contemplated and are within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments without departing from the scope of the disclosure.

What is claimed is:

1. A blank for forming a container, the blank comprising:

a central portion;

an edge; and a marginal portion between the edge and the central portion, the blank comprising a radius extending from a center of the blank to the edge, the marginal portion comprising a plurality of score lines, each score line being positioned to intersect the radius and being positioned at an angle relative to the radius of the blank that intersects the score line, each of the score lines comprise a first end point and a second end point, the first end point being spaced inward from the edge and the second end point being adjacent the central portion, adjacent score lines of the plurality of score lines each have respective first end points spaced apart a first distance, and the adjacent score lines each have respective second end points spaced apart a second distance, the first distance is greater than the second distance.

2. The blank of claim 1 wherein the first distance is at least approximately 25% greater than the second distance.

3. The blank of claim 1 wherein the angle is at least approximately 15 degrees.

4. The blank of claim 1 wherein the angle is at least approximately 30 degrees.

5. A blank for forming a container, the blank comprising:

a central portion;

an edge; and a marginal portion between the edge and the central portion, the blank comprising a radius extending from a center of the blank to the edge, the marginal portion comprising a plurality of score lines, each score line being positioned to intersect the radius and being positioned at an angle relative to the radius of the blank that intersects the score line, each of the score lines comprise a first end point and a second end point, the first end point being spaced inward from the edge and the second end point being adjacent the central portion, and the angle is at least approximately 60 degrees.

6. The blank of claim 1 wherein the score lines each have a length between the end points, the length being at least approximately 10% of the radius.

7. A blank for forming a container, the blank comprising:

a central portion;

an edge; and a marginal portion between the edge and the central portion, the blank comprising a radius extending from a center of the blank to the edge, the marginal portion comprising a plurality of score lines, each score line being positioned to intersect the radius and being positioned at an angle relative to the radius of the blank that intersects the score line, each of the score lines comprise a first end point and a second end point the first end point being spaced inward from the edge and the second end point being adjacent the central portion, adjacent score lines of the plurality of score lines each have respective first end points spaced apart a first distance, and the adjacent score lines each have respective second end points spaced apart a second distance, the score lines each have a length between the end points, the length being at least approximately 30% of the radius.

8. A container formed from a blank, the blank comprising a central portion;

an edge; and a marginal portion between the edge and the central portion, the blank comprising a radius extending from a center of the blank to the edge, the marginal portion comprising a plurality of score lines, each score line being positioned to intersect the radius and being positioned at an angle relative to the radius of the blank that intersects the score line, each of the score lines comprise a first end point and a second end point the first end point being spaced inward from the edge and the second end point being adjacent the central portion;

the container comprising:

a bottom wall formed from the central portion, a side wall extending upwardly from the bottom wall and being formed from at least a portion of the marginal portion; and a flange extending laterally outward from the side wall and being formed from at least a portion of the marginal portion, the container has overlapped portions in at least a portion of the side wall and the flange, the overlapped portions being formed from the score lines in the blank and forming a first plurality of protrusions on an interior surface of the container and a second plurality of protrusions on an exterior surface of the container.

9. The container of claim 8 further comprising a stacking lug on the exterior surface extending around the side wall.

10. The container of claim 9 wherein the side wall comprises two compressed portions adjacent the stacking lug, the compressed portions each comprise a portion of the surface area of the exterior surface of the container wherein the overlapped portions are compressed.

11. The container of claim 10 wherein the stacking lugs protrude laterally outward from the compressed portions and form denesting features for separating stacked containers.

* * * * *